US011509991B1

(12) United States Patent
Lien et al.

(10) Patent No.: US 11,509,991 B1
(45) Date of Patent: Nov. 22, 2022

(54) HEADBAND STRUCTURE OF HEADPHONE

(71) Applicant: Merry Electronics Co., Ltd., Taichung (TW)

(72) Inventors: Yo-Cheng Lien, Taichung (TW); Fang-Chang Hsieh, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 0 days.

(21) Appl. No.: 17/467,281

(22) Filed: Sep. 6, 2021

(30) Foreign Application Priority Data

Aug. 9, 2021 (CN) ..... 202121848672.X

(51) Int. Cl.
*H04R 25/00* (2006.01)
*H04R 1/10* (2006.01)

(52) U.S. Cl.
CPC ..... *H04R 1/105* (2013.01)

(58) Field of Classification Search
CPC .... H04R 1/105; H04R 1/1008; H04R 1/1066; H04R 1/1075; H04R 1/1033; H04R 5/033; H04R 2420/07; H04R 7/00; H04R 1/1041; H04R 1/1091
See application file for complete search history.

(56) References Cited

U.S. PATENT DOCUMENTS 6,724,906 B2 * 4/2004 Naksen ..... H04R 1/1066 381/370
8,861,770 B2 * 10/2014 Blair ..... H04R 1/1058 381/378

* cited by examiner

*Primary Examiner* — Amir H Etesam
(74) *Attorney, Agent, or Firm* — JCIPRNET

(57) ABSTRACT

A headband structure of a headphone, including a headband assembly and a telescopic adjustment module, is provided. The headband assembly has a steel belt. The steel belt has multiple positioning slots. The telescopic adjustment module includes a fixing base, an elastic sheet, and a positioning ball. The fixing base is slidably disposed to the steel belt. The elastic sheet is disposed to the fixing base, and the elastic sheet has an accommodating groove. The positioning ball is disposed in the accommodating groove, and the positioning ball is located between the steel belt and the elastic sheet. The elastic sheet constantly pushes the positioning ball to keep the positioning ball in contact with the steel belt, and the positioning slots are located on moving paths of the positioning ball.

10 Claims, 4 Drawing Sheets

HEADBAND STRUCTURE OF HEADPHONE

CROSS-REFERENCE TO RELATED APPLICATION

This application claims the priority benefit of China application serial no. 202121848672.X, filed on Aug. 9, 2021. The entirety of the above-mentioned patent application is hereby incorporated by reference herein and made a part of this specification.

BACKGROUND

Technical Field

The disclosure relates to a headband structure, and particularly to a headband structure applied to a headphone.

Description of Related Art

Generally speaking, in order to adapt to heads with different sizes and shapes of users, the headband structure of the headphone is provided with a telescopic adjustment module for the user to adjust by himself. At present, a common design is that when a yoke is stretched, an elastic sheet is used to snap into each segment of a groove structure to adjust the headband structure of the headphone to a fixed size. However, when the yoke is stretched, the elastic sheet generates friction during the sliding process, which is easily worn, so the service life is relatively short, and the stretching force of the telescopic adjustment module decreases with the increase in the degree of wear, causing the headband structure of the headphone to be increasingly difficult to be accurately positioned to a specific size.

SUMMARY

The disclosure provides a headband structure of a headphone, which improves the service life by reducing friction and helps to ensure that the headband structure of the headphone is accurately positioned to a specific size.

The headband structure of the headphone of the disclosure includes a headband assembly and a telescopic adjustment module. The headband assembly has a steel belt. The steel belt has multiple positioning slots. The telescopic adjustment module includes a fixing base, an elastic sheet, and a positioning ball. The fixing base is slidably disposed to the steel belt. The elastic sheet is disposed to the fixing base, and the elastic sheet has an accommodating groove. The positioning ball is disposed in the accommodating groove, and the positioning ball is located between the steel belt and the elastic sheet. The elastic sheet constantly pushes the positioning balls to keep the positioning balls in contact with the steel belt, and the positioning slots are located on moving paths of the positioning ball.

In an embodiment of the disclosure, the fixing base includes a first base body and a second base body. The first base body is slidably disposed to one side of the steel belt. The elastic sheet is disposed to the first base body. The second base body is slidably disposed to other side of the steel belt.

In an embodiment of the disclosure, the fixing base has two supporting portions. The elastic sheet is disposed to the two supporting portions, and the elastic sheet is located between the steel belt and the two supporting portions.

In an embodiment of the disclosure, the fixing base has a space. The elastic sheet is located in the space.

In an embodiment of the disclosure, the accommodating groove has a first opening and a second opening. A distance between the first opening and the steel belt is greater than a distance between the second opening and the steel belt. An inner diameter of the first opening is less than an outer diameter of the positioning ball. An inner diameter of the second opening is greater than the outer diameter of the positioning ball.

In an embodiment of the disclosure, the accommodating groove has a first opening and a second opening. A distance between the first opening and the steel belt is greater than a distance between the second opening and the steel belt. A portion of the positioning ball protrudes from the second opening.

In an embodiment of the disclosure, a shape of the positioning slot includes a long slot, an elliptical slot, or a circular slot. The positioning slots are disposed at intervals along an extending direction of the steel belt.

In an embodiment of the disclosure, the steel belt includes a main body and two sliding sections. The two sliding sections are respectively connected to two opposite sides of the main body, and the positioning slots are located on the sliding sections.

In an embodiment of the disclosure, the telescopic adjustment module further includes a connecting member and a connecting base. One end of the connecting member is connected to the fixing base. The connecting base is connected to other end of the connecting member.

In an embodiment of the disclosure, the headband assembly includes a first housing and a second housing. The first housing is disposed to the steel belt. The second housing is disposed to the steel belt, and the second housing is connected to the first housing. The first housing and the second housing are respectively located on two opposite sides of the steel belt.

Based on the above, in the headband structure of the headphone of the disclosure, the elastic sheet is disposed to the fixing base, and the elastic sheet has the accommodating groove. The positioning ball is disposed in the accommodating groove, and the positioning ball is located between the steel belt and the elastic sheet. The elastic sheet constantly pushes the positioning ball to keep the positioning ball in contact with the steel belt, and the positioning slots are located on the moving paths of the positioning ball, which improves the service life by reducing friction and helps to ensure that the headband structure of the headphone is accurately positioned to a specific size.

In order for the features and advantages of the disclosure to be more comprehensible, the following specific embodiment is provided in conjunction with the accompanying drawings for detailed description.

DETAILED DESCRIPTION OF DISCLOSED EMBODIMENTS

Figure 1:
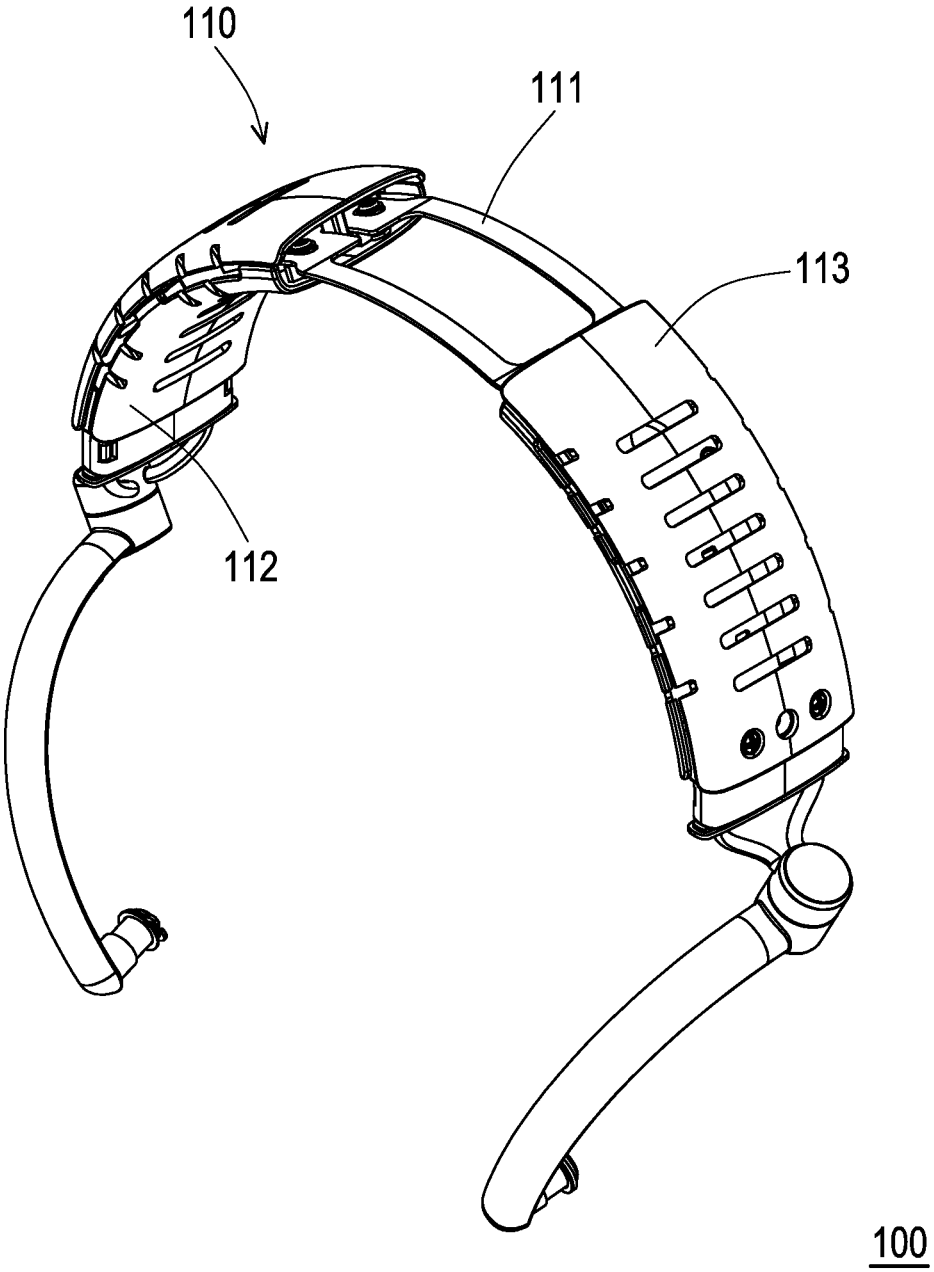
FIG. 1 is a three-dimensional schematic diagram of a headband structure of a headphone according to an embodiment of the disclosure.
Figure 2:
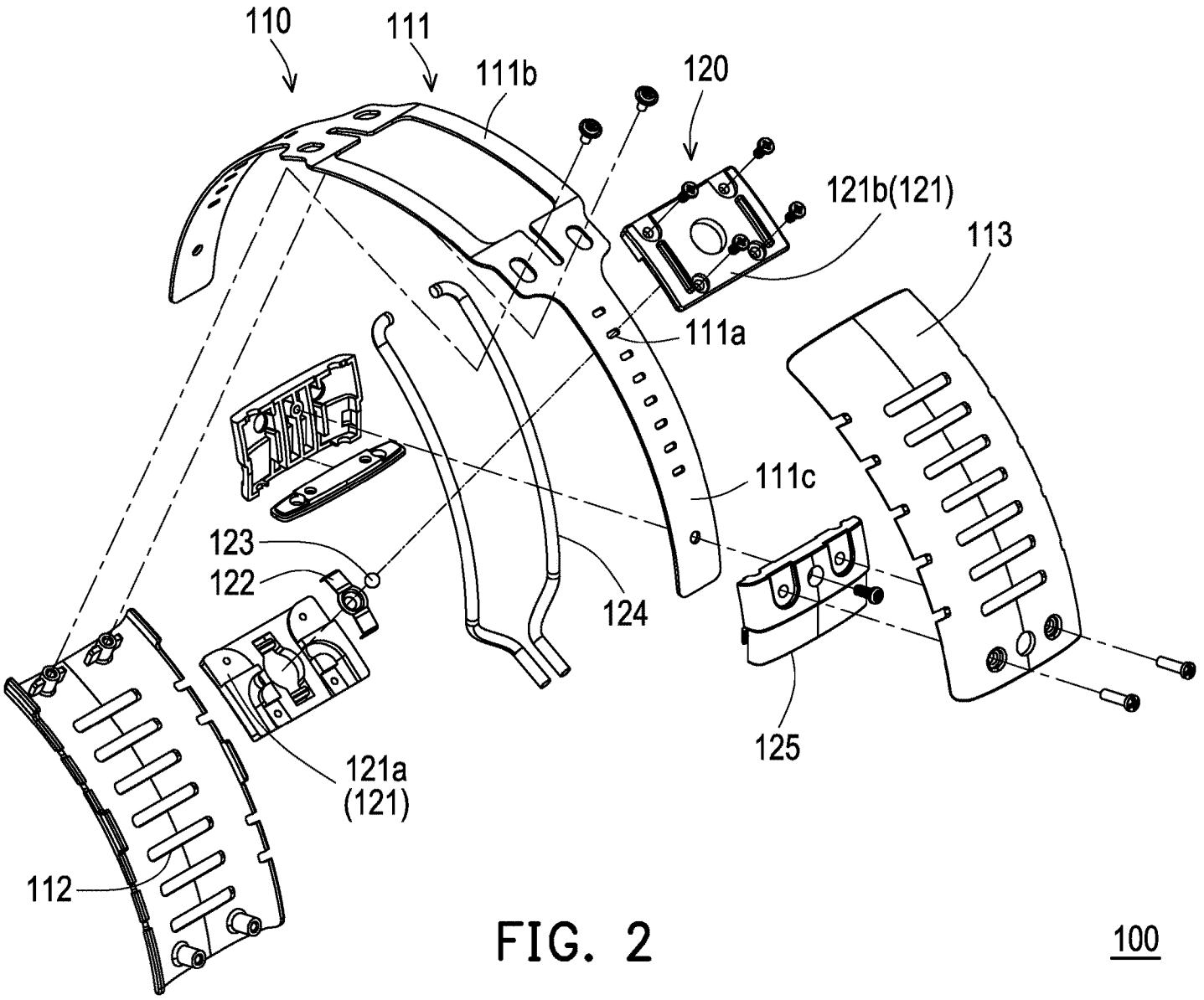
FIG. 2 is an exploded schematic diagram of the headband structure of the headphone of FIG. 1.
Figure 3:
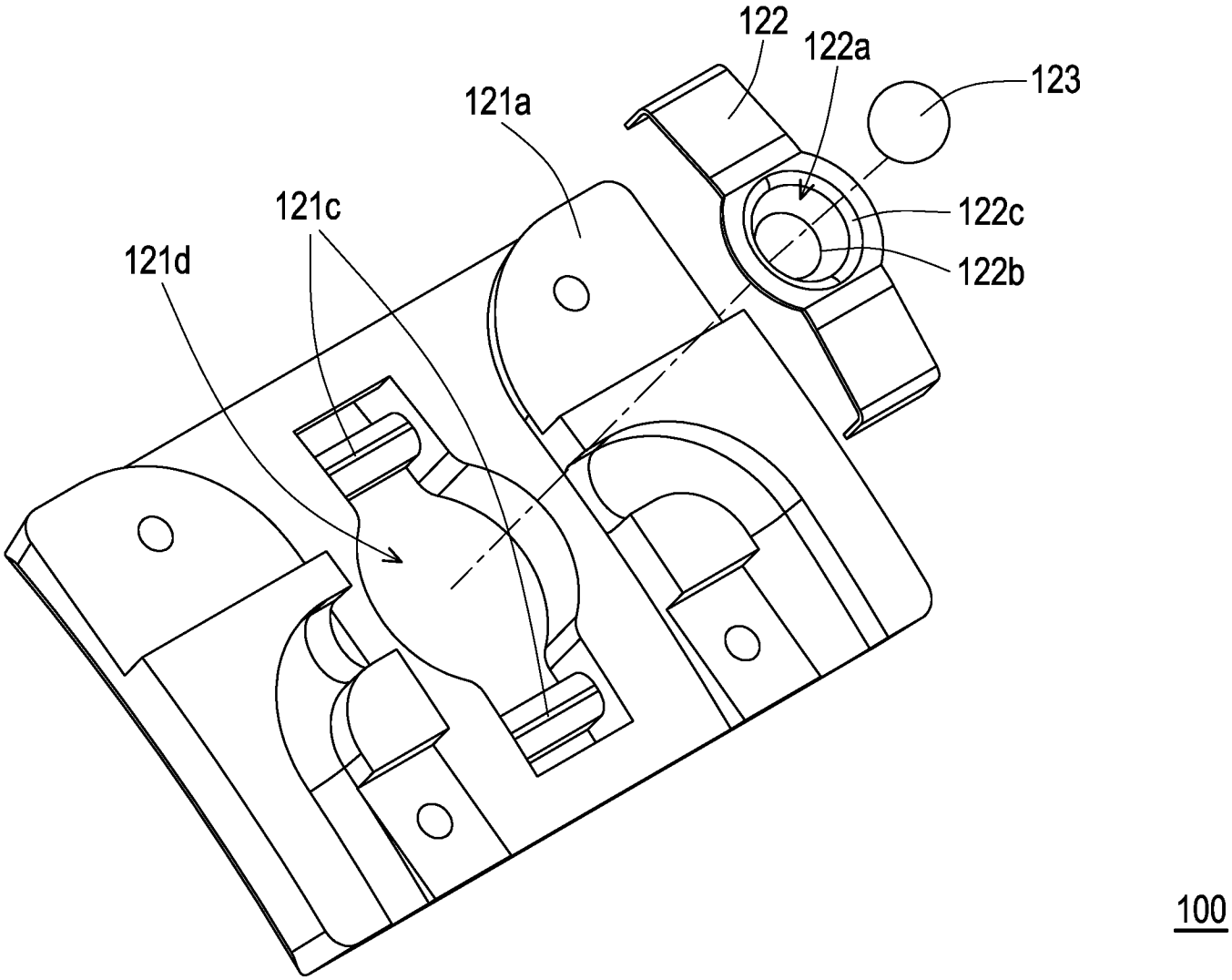
FIG. 3 is a partial enlarged schematic diagram of the headband structure of the headphone of FIG. 2.
Figure 4:
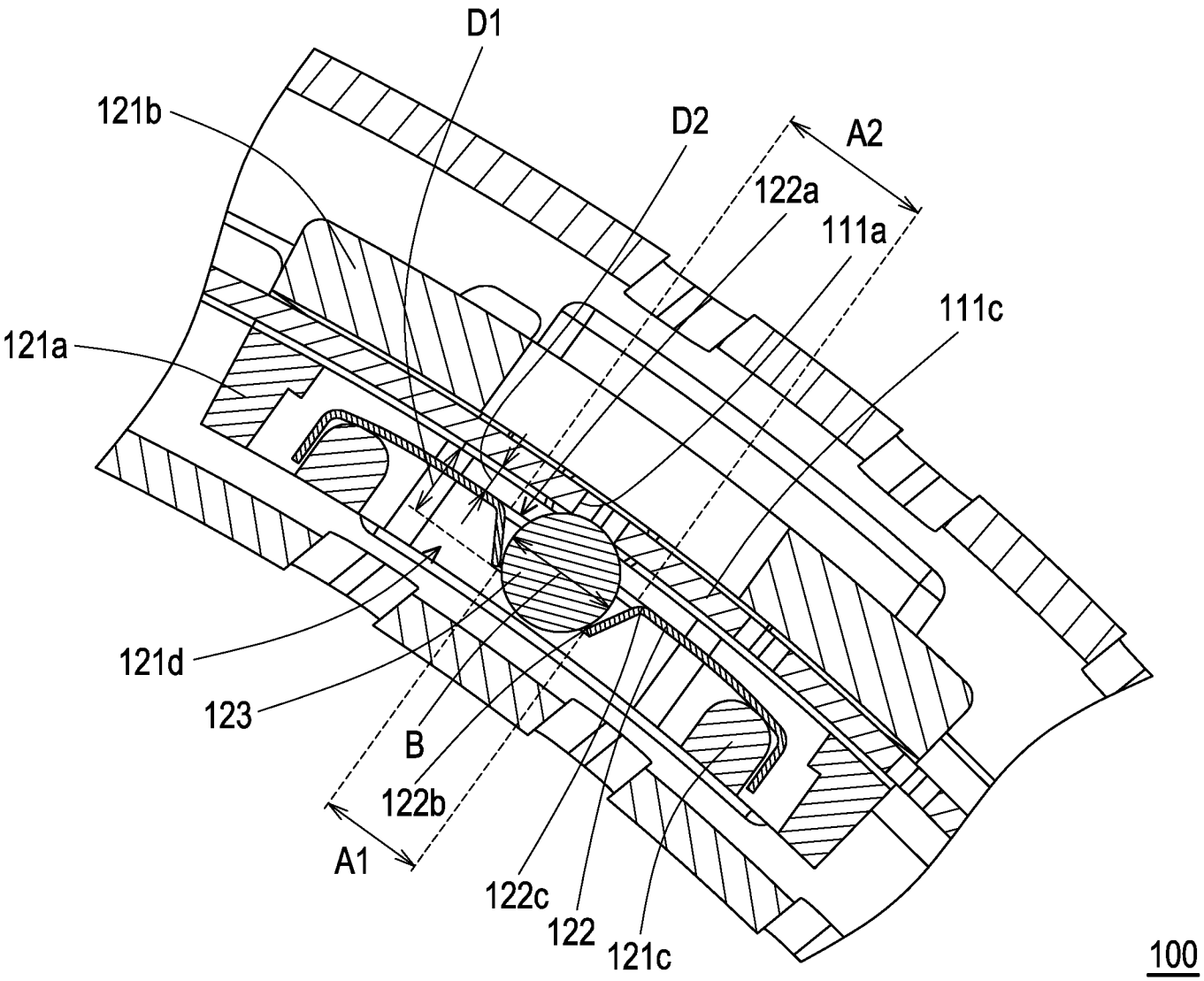
FIG. 4 is a partial cross-sectional schematic diagram of the headband structure of the headphone of FIG. 1.

FIG. 1 is a three-dimensional schematic diagram of a headband structure of a headphone according to an embodiment of the disclosure. FIG. 2 is an exploded schematic diagram of the headband structure of the headphone of FIG. 1. FIG. 3 is a partial enlarged schematic diagram of the headband structure of the headphone of FIG. 2. FIG. 4 is a partial cross-sectional schematic diagram of the headband structure of the headphone of FIG. 1. Please refer to FIG. 1, FIG. 2, FIG. 3, and FIG. 4. A headband structure 100 of the headphone of the embodiment includes a headband assembly 110 and a telescopic adjustment module 120.

In detail, the headband assembly 110 has a steel belt 111. The steel belt 111 has multiple positioning slots 111*a*. The telescopic adjustment module 120 includes a fixing base 121, an elastic sheet 122, and a positioning ball 123. The fixing base 121 is slidably disposed to the steel belt 111. The elastic sheet 122 is disposed to the fixing base 121, and the elastic sheet 122 has an accommodating groove 122*a*. The positioning ball 123 is disposed in the accommodating groove 122*a*, and the positioning ball 123 is located between the steel belt 111 and the elastic sheet 122. The elastic sheet 122 constantly pushes the positioning ball 123 to keep the positioning ball 123 in contact with the steel belt 111, and the positioning slots 111*a* are located on moving paths of the positioning ball 123. The positioning ball 123 is in contact with the steel belt 111 in a point contact manner, which can reduce the friction of the positioning ball 123 to improve the service life and help to ensure that the headband structure 100 of the headphone is accurately positioned to a specific size.

In addition, the material of the steel belt 111 contacted by the positioning ball 123 is wear resistant, which also helps to increase the service life and ensure that the headband structure 100 of the headphone is accurately positioned to a specific size.

Furthermore, the positioning slot 111*a* is directly manufactured on the steel belt 111 of a yoke, so the structure is relatively simple.

The headband assembly 110 includes a first housing 112 and a second housing 113. The first housing 112 and the second housing 113 are disposed to the steel belt 111. The second housing 113 is connected to the first housing 112. The first housing 112 and the second housing 113 are respectively located on two opposite sides of the steel belt 111.

The steel belt 111 includes a main body 111*b* and two sliding sections 111*c*. The two sliding sections 111*c* are respectively connected to two opposite sides of the main body 111*b*, and the positioning slots 111*a* are located on the sliding sections 111*c*. The positioning slots 111*a* are disposed at intervals along an extending direction of the steel belt 111.

The fixing base 121 includes a first base body 121*a*, a second base body 121*b*, two supporting portions 121*c*, and a space 121*d*. The first base body 121*a* is slidably disposed to one side of the steel belt 111. The elastic sheet 122 is disposed to the first base body 121*a*. The second base body 121*b* is slidably disposed to the other side of the steel belt 111. The elastic sheet 122 is disposed to the two supporting portions 121*c*, and the elastic sheet 122 is located between the steel belt 111 and the two supporting portions 121*c*. The elastic sheet 122 is located in the space 121*d*.

The accommodating groove 122*a* has a first opening 122*b* and a second opening 122*c*. A distance D1 between the first opening 122*b* and the steel belt 111 is greater than a distance D2 between the second opening 122*c* and the steel belt 111. An inner diameter A1 of the first opening 122*b* is less than an outer diameter B of the positioning ball 123. An inner diameter A2 of the second opening 122*c* is greater than the outer diameter B of the positioning ball 123. A portion of the positioning ball 123 protrudes from the second opening 122*c*. In other words, the positioning ball 123 located in the accommodating groove 122*a* is limited by the first opening 122*b* to be located between the elastic sheet 122 and the steel belt 111.

In the embodiment, the shape of the positioning slot 111*a* is a long slot shape. The positioning ball 123 does not need to be over-precisely installed to a specific position. Therefore, the precision requirement of assembly is relatively low, which helps to increase the speed of assembly, thereby reducing the manufacturing cost.

In other embodiments, the shape of the positioning slot 111*a* may include an elliptical slot or a circular slot.

The telescopic adjustment module 120 further includes a connecting member 124 and a connecting base 125. One end of the connecting member 124 is connected to the fixing base 121. The connecting base 125 is connected to the other end of the connecting member 124.

In summary, in the headband structure of the headphone of the disclosure, the elastic sheet is disposed to the fixing base, and the elastic sheet has the accommodating groove. The positioning ball is disposed in the accommodating groove, and the positioning ball is located between the steel belt and the elastic sheet. The elastic sheet constantly pushes the positioning ball to keep the positioning ball in contact with the steel belt, and the positioning slots are located on the moving paths of the positioning ball. The positioning ball is in contact with the steel belt in a point contact manner, which can reduce the friction of the positioning ball to improve the service life and help to ensure that the headband structure of the headphone is accurately positioned to a specific size.

In addition, the material of the steel belt contacted by the positioning ball is wear resistant, which also helps to increase the service life and ensure that the headband structure of the headphone is accurately positioned to a specific size.

Although the embodiment is as disclosed above, the embodiment is not intended to limit the disclosure. Persons skilled in the art may make some changes and retouching without departing from the spirit and scope of the disclosure. Therefore, the protection scope of the disclosure shall be defined by of the appended claims.

What is claimed is:

1. A headband structure of a headphone, comprising:

a headband assembly, having a steel belt, wherein the steel belt has a plurality of positioning slots; and a telescopic adjustment module, comprising:

a fixing base, slidably disposed to the steel belt;

an elastic sheet, disposed to the fixing base and having an accommodating groove; and a positioning ball, disposed in the accommodating groove and located between the steel belt and the elastic sheet, wherein the elastic sheet constantly pushes the positioning ball to keep the positioning ball in contact with the steel belt, and the positioning slots are located on moving paths of the positioning ball.

2. The headband structure of the headphone according to claim 1, wherein the fixing base comprises:

a first base body, slidably disposed to one side of the steel belt, wherein the elastic sheet is disposed to the first base body; and a second base body, slidably disposed to other side of the steel belt.

3. The headband structure of the headphone according to claim 1, wherein the fixing base has two supporting portions, the elastic sheet is disposed to the two supporting portions, and the elastic sheet is located between the steel belt and the two supporting portions.

4. The headband structure of the headphone according to claim 1, wherein the fixing base has a space, and the elastic sheet is located in the space.

5. The headband structure of the headphone according to claim 1, wherein the accommodating groove has a first opening and a second opening, a distance between the first opening and the steel belt is greater than a distance between the second opening and the steel belt, an inner diameter of the first opening is less than an outer diameter of the positioning ball, and an inner diameter of the second opening is greater than the outer diameter of the positioning ball.

6. The headband structure of the headphone according to claim 1, wherein the accommodating groove has a first opening and a second opening, a distance between the first opening and the steel belt is greater than a distance between the second opening and the steel belt, and a portion of the positioning ball protrudes from the second opening.

7. The headband structure of the headphone according to claim 1, wherein a shape of the positioning slot comprises a long slot, an elliptical slot, or a circular slot, and the positioning slots are disposed at intervals along an extending direction of the steel belt.

8. The headband structure of the headphone according to claim 1, wherein the steel belt comprises:

a main body; and two sliding sections, respectively connected to two opposite sides of the main body, wherein the positioning slots are located on the sliding sections.

9. The headband structure of the headphone according to claim 1, wherein the telescopic adjustment module further comprises:

a connecting member with one end connected to the fixing base; and a connecting base, connected to other end of the connecting member.

10. The headband structure of the headphone according to claim 1, wherein the headband assembly comprises:

a first housing, disposed to the steel belt; and a second housing, disposed to the steel belt and connected to the first housing, wherein the first housing and the second housing are respectively located on two opposite sides of the steel belt.

* * * * *